US007330677B2

(12) United States Patent
Ogura

(10) Patent No.: US 7,330,677 B2
(45) Date of Patent: Feb. 12, 2008

(54) IMAGE-FORMING APPARATUS AND METHOD FOR CONTROLLING THE SAME

(75) Inventor: Keigo Ogura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 11/253,263

(22) Filed: Oct. 18, 2005

(65) Prior Publication Data

US 2006/0083534 A1 Apr. 20, 2006

(30) Foreign Application Priority Data

Oct. 19, 2004 (JP) ..... 2004-304519

(51) Int. Cl.
*G03G 15/00* (2006.01)

(52) U.S. Cl. ..... 399/88

(58) Field of Classification Search ..... 399/9, 399/11, 13, 38, 75, 81, 88
See application file for complete search history.

(56) References Cited

U.S. PATENT DOCUMENTS 5,966,555 A * 10/1999 Nakajima et al. ..... 399/18
6,847,794 B2 1/2005 Namura
7,031,639 B2 * 4/2006 Masuda et al. ..... 399/124
7,278,705 B2 * 10/2007 Ohara ..... 347/23

FOREIGN PATENT DOCUMENTS

JP 2000-318265 11/2000

* cited by examiner

*Primary Examiner*—Hoan Tran
(74) *Attorney, Agent, or Firm*—Canon U.S.A. Inc I.P. Div

(57) ABSTRACT

An image-forming apparatus configured to form an image on a paper medium is connected to a plurality of auxiliary apparatuses configured to carry out predetermined processes on the paper medium ejected from the image-forming apparatus. An electrical power control unit controls the electrical power supply to at least each of the auxiliary apparatuses in accordance with the operational state of the image-forming apparatus or in accordance with the setting or commands received from outside.

17 Claims, 9 Drawing Sheets

IMAGE-FORMING APPARATUS AND METHOD FOR CONTROLLING THE SAME

BACKGROUND OF THE INVENTION

1. Field of the Invention

The present invention relates to an image-forming apparatus and a method for controlling the image-forming apparatus.

2. Description of the Related Art

Known multi-function apparatuses, capable of copying documents, transmitting and receiving image data, and carrying out a printing process in accordance with image data, have many features for reducing power consumption.

For example, a method for dividing the power supply used to supply electrical power to the multi-function apparatus mainly into a power supply for a control system and a power supply for a printing system has been proposed (Japanese Patent Laid-Open No. 2000-318265). In this case, the power supply for the control system continuously supplies power, whereas the power supply for the printing system is turned on and off in accordance with the operation mode of the multi-function apparatus. The operation modes include a print mode in which power is supplied to the printing system and a stand-by mode in which power is not supplied to the printing system.

A known multi-function apparatus is connected to a sheet-processing apparatus that is capable of processing a printed sheet in various ways. Sheet processing includes, for example, sheet post-processing (stapling and punching), sheet-ejection, and sheet conveying.

In a multi-function apparatus connected to a plurality of sheet-processing apparatuses, the same electrical power control is used for both the plurality of sheet-processing apparatuses and the printing system. Thus, the power supply of a multi-function apparatus supplies electrical power to the sheet-processing apparatus in printing mode and does not supply power to the sheet-processing apparatus in stand-by mode.

In most cases, a known multi-function apparatus connected to a plurality of sheet-processing apparatuses only operates a predetermined sheet-processing apparatus and does not operate the other sheet-processing apparatuses. However, in the printing mode of a known multi-function apparatus, electrical power is supplied to all sheet-processing apparatuses connected to the multi-function apparatus. Therefore, extra electrical power is consumed by sheet-processing apparatuses not operated in the printing mode.

SUMMARY OF THE INVENTION

The present invention is directed to an image-forming apparatus and a method for controlling the same. In one aspect of the present invention, an image-forming apparatus includes an input unit configured to input an image-forming job including image information corresponding to a plurality of pages and predetermined processing condition information, an image-forming unit configured to form an image on a sheet on the basis of the image information of the image-forming job, a first sheet-processing unit configured to process a sheet on which an image is formed by the image-forming unit, a second sheet-processing unit configured to process a sheet on which an image is formed by the image-forming unit, an electrical power control unit configured to control electrical power supply to the first sheet-processing unit and the second sheet-processing unit, and a determining unit configured to determine whether or not sheet processing for the image-forming job is to be carried out by one of the first sheet-processing unit and the second sheet-processing unit on the basis of the processing condition information included in the image-forming job input by the input unit, wherein the electrical power control unit shuts off electrical power supply to the first sheet-processing unit responsive to the determining unit determining that sheet processing by the first sheet-processing unit is not carried out for a first amount of time and the electrical power control unit shuts off electrical power supply to the second sheet-processing unit responsive to the determining unit determining that sheet processing by the second sheet-processing unit is not carried out for a second amount of time.

According to another aspect of the present invention, a method for controlling an image-forming apparatus includes the steps of inputting an image-forming job including image information corresponding to a plurality of pages and predetermined processing condition information, forming an image on a sheet on the basis of the image information of the image-forming job, controlling an electrical supply to a first sheet-processing unit and a second sheet-processing unit that are capable of forming an image on a sheet in the forming step, and determining whether or not sheet processing for the image-forming job is to be carried out by the first sheet-processing unit or the second sheet-processing unit on the basis of the processing condition information included in the image-forming job input in the inputting step, wherein the electrical power supply to the first sheet-processing unit is shut off in the controlling step when it is determined in the determining step that sheet processing by the first sheet-processing unit is not carried out for a first amount of time and the electrical power supply to the second sheet-processing unit is shut off in the controlling step when it is determined in the determining step that sheet processing by the second sheet-processing unit is not carried out for a second amount of time.

According to another aspect of the present invention, an image-forming apparatus includes: an input unit configured to input an image-forming job including image information corresponding to a plurality of pages and predetermined processing condition information; an image-forming unit configured to form an image on a sheet on the basis of the image information of the image-forming job; a plurality of sheet-processing units configured to process a sheet on which an image is formed by the image-forming unit; and an electrical power control unit configured to control electrical power supply to the plurality of sheet-processing units based on an information, that shows at least one sheet-processing unit used by the image-forming job, included in the predetermined processing condition information. Other features of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
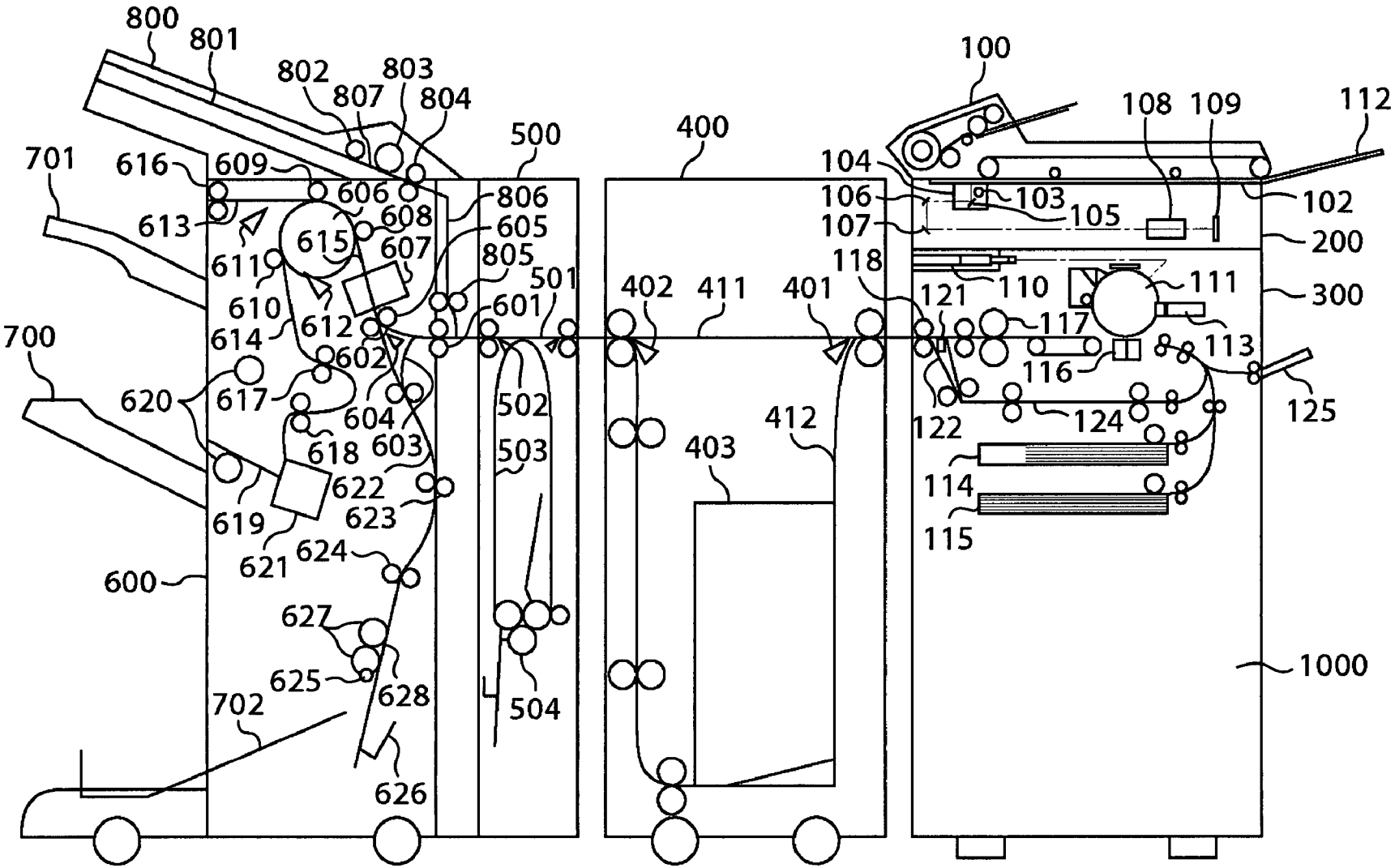
FIG. 1 is a cross-sectional view of the structure of an image-forming system according to an embodiment of the present invention.

The present invention will now be described in detail with reference to the drawings showing an exemplary embodiment thereof. In the drawings, elements and parts which are identical throughout the views are designated by identical reference numerals, and duplicate description thereof is omitted.

Embodiments of the present invention will be described below with reference to the drawings.

First Embodiment

FIG. 1 is a cross-sectional view of the structure of an image-forming system according to an embodiment of the present invention.

The image-forming system includes an image-forming apparatus 1000, a buffer module 400, a folding apparatus 500, and a finisher main body 600.

The image-forming apparatus 1000 includes a document-conveying apparatus 100, an image reader 200, and a printer 300.

The document-conveying apparatus 100 conveys the document set in the apparatus one page at a time from the first page in sequence from left to right on a platen glass 102 through a curved path. Then, the pages of the document are sent to an ejection tray 112. At this time, a scanner unit 104 is held in a predetermined position. The pages of the document are scanned by being passed over the scanner unit 104 from left to right.

When a page of the document is passed over the scanner unit 104, light from a lamp 103 of the scanner unit 104 is radiated on the page. The light reflected at the surface of the page is guided to an image sensor 109 via mirrors 105, 106 and 107 and a lens 108. The document may also be read by conveying a page of the document onto the platen glass 102 by the document-conveying apparatus 100 and holding the page while the scanner unit 104 is moved left to right.

The image of the document read by the image sensor 109 is processed and is sent to an exposure control unit 110. The exposure control unit 110 emits a laser beam in accordance with an image signal. The laser beam is radiated on a photoconductive drum 111 so as to form an electrostatic latent image on the photoconductive drum 111. The electrostatic latent image on the photoconductive drum 111 is developed by a development unit 113. The developer on the photoconductive drum 111 is transferred onto a sheet of paper supplied from cassettes 114 or 115, a manual paper-feeder 125, or a sheet-reversing path 124 at a transfer unit 116.

A fixing process of the developer transferred onto the sheet of paper is carried out by a fixing unit 117. After passing through the fixing unit 117, the sheet of paper is guided once to a path 122 by a flapper 121. Then, after the rear edge of the sheet passes by the flapper 121, the sheet is guided in the reverse direction to an ejection roller 118 by the flapper 121.

In this way, the sheet is ejected from the printer 300 by the ejection roller 118 with the surface on which the developer is transferred facing downward.

When an image is formed on a hard sheet, such as an overhead projector (OHP) sheet, supplied from the manual paper-feeder 125, the sheet is not guided to the path 122 but ejected by the ejection roller 118 with the surface on which the developer is transferred facing upward.

When images are formed on both sides of a sheet, the sheet is directly guided to the ejection roller 118 from the fixing unit 117. Then, after the rear edge of the sheet passes by the flapper 121, the sheet is guided in the reverse direction to the sheet-reversing path 124 by the flapper 121.

The sheet ejected from the ejection roller 118 is sent to the buffer module 400.

The buffer module 400 includes a buffer tray 403 where sheets can be temporarily stored. The sheet ejected from the image-forming apparatus 1000 is next sent to the folding apparatus 500 or the finisher main body 600 at a speed in accordance with the processing speed. The buffer module 400 sends the sheet ejected from the image-forming apparatus 1000 to a through path 411 or an inlet path 412 by switching an inlet switching flapper 401 and an outlet switching flapper 402. In this way, the processing speed between the image-forming apparatus 1000 and the post-processing apparatuses (i.e., folding apparatus 500 and finisher main body 600) is adjusted. The control of the buffer module 400 is described in detail below.

The folding apparatus 500 folds a sheet into a Z-shape. The folding apparatus 500 includes a folding and conveying horizontal path 501 for receiving a sheet ejected from the buffer module 400 and guiding the sheet to the finisher main body 600. A folding path selecting flapper 502 is provided on the outlet of the folding and conveying horizontal path 501 (on the finisher main body 600 side). When folding a sheet, the folding path selecting flapper 502 is turned on, and the sheet is guided to a folding path 503. The sheet guided to the folding path 503 is conveyed to a folding roller 504 and is folded into a Z-shape. In a case in which the sheet is not folded, the folding path selecting flapper 502 is turned off and the sheet is directly sent to the finisher main body 600 from the buffer module 400 through the folding and conveying horizontal path 501.

At the finisher main body 600, processes such as sorting, binding, and punching are carried out. The finisher main body 600 includes a pair of inlet rollers 601 for guiding the sheet ejected from the folding apparatus 500 to inside the finisher main body 600. A switching flapper 604 for guiding the sheet to a finisher path 602 or a first bookbinding path 603 is provided downstream of the pair of inlet rollers 601.

The sheet guided to the finisher path 602 is sent to a buffer roller 606 through a pair of conveying rollers 605. The pair of conveying rollers 605 and the buffer roller 606 are capable of rotating in forward and backward directions.

A punching unit 607 is interposed between the pair of conveying rollers 605 and the buffer roller 606 so as to punch holes in the rear area of the conveyed sheet, if required.

The buffer roller 606 is capable of winding a predetermined number of sheets conveyed through the pair of conveying rollers 605 around its circumference. Sheets are wound around the circumference of the buffer roller 606 by pressing rollers 608, 609, and 610.

A switching flapper 611 is interposed between the pressing rollers 609 and 610. A switching flapper 612 is disposed downstream of the pressing roller 610. The switching flapper 611 is for separating the sheets wound around the buffer roller 606 from the buffer roller 606 and for guiding the separated sheets to a non-sorting path 613 or a sorting path 614. The switching flapper 612 is for guiding the sheets wound around the buffer roller 606 to the sorting path 614 or a buffer path 615.

The sheet guided to the non-sorting path 613 is ejected into a sample tray 701 through a pair of ejection rollers 616. The sheet guided to the sorting path 614 is loaded onto an intermediate tray 619 after passing through a pair of conveying rollers 617 and a pair of ejection rollers 618. The stack of sheets loaded on the intermediate tray 619 is aligned and stapled, if required. Then, the stack of sheets is ejected into a stack tray 700 through an ejection roller 620.

A stapler 621 is used to staple the stack of sheets loaded on the intermediate tray 619. The stack tray 700 can automatically move in the vertical direction.

A sheet from the first bookbinding path 603 and a second bookbinding path 622 is stored in a storage guide by a pair of first conveying rollers 623 and a pair of second conveying rollers 624. Moreover, the sheet is conveyed by a third conveying roller 625 until the front edge of the sheet comes into contact with a movable sheet-alignment member 626. Then, a crease is made on a stack of sheets, and the stack is folded by a pair of folding rollers 627 and a projection member 628. Subsequently, the stack is ejected to a saddle tray 702.

An inserter 800 is provided at the upper portion of the finisher main body 600. The inserter 800 separates the sheets in the stack loaded on a tray 801 and sends the sheets in sequence to the finisher path 602 or the second bookbinding path 622.

The stack of sheets is set with the front surface facing upwards and sent to a separation unit including a conveying roller 803 and a separation belt 807 by a paper-feeding roller 802. At the separation unit, the sheets in the stack are separated one sheet at a time from the top of the stack.

A pair of drawing rollers 804 are disposed downstream of the separation unit to reliably convey the separated sheets downstream. A pair of conveying rollers 805 is interposed between the pair of inlet rollers 601 and the pair of drawing rollers 804.

A conveying path 806 from the inserter 800 merges into a conveying path from the buffer module 400 upstream of the pair of inlet rollers 601.

Next, the structure of the buffer module 400 will be described in detail with reference to FIG. 2.

Figure 2:
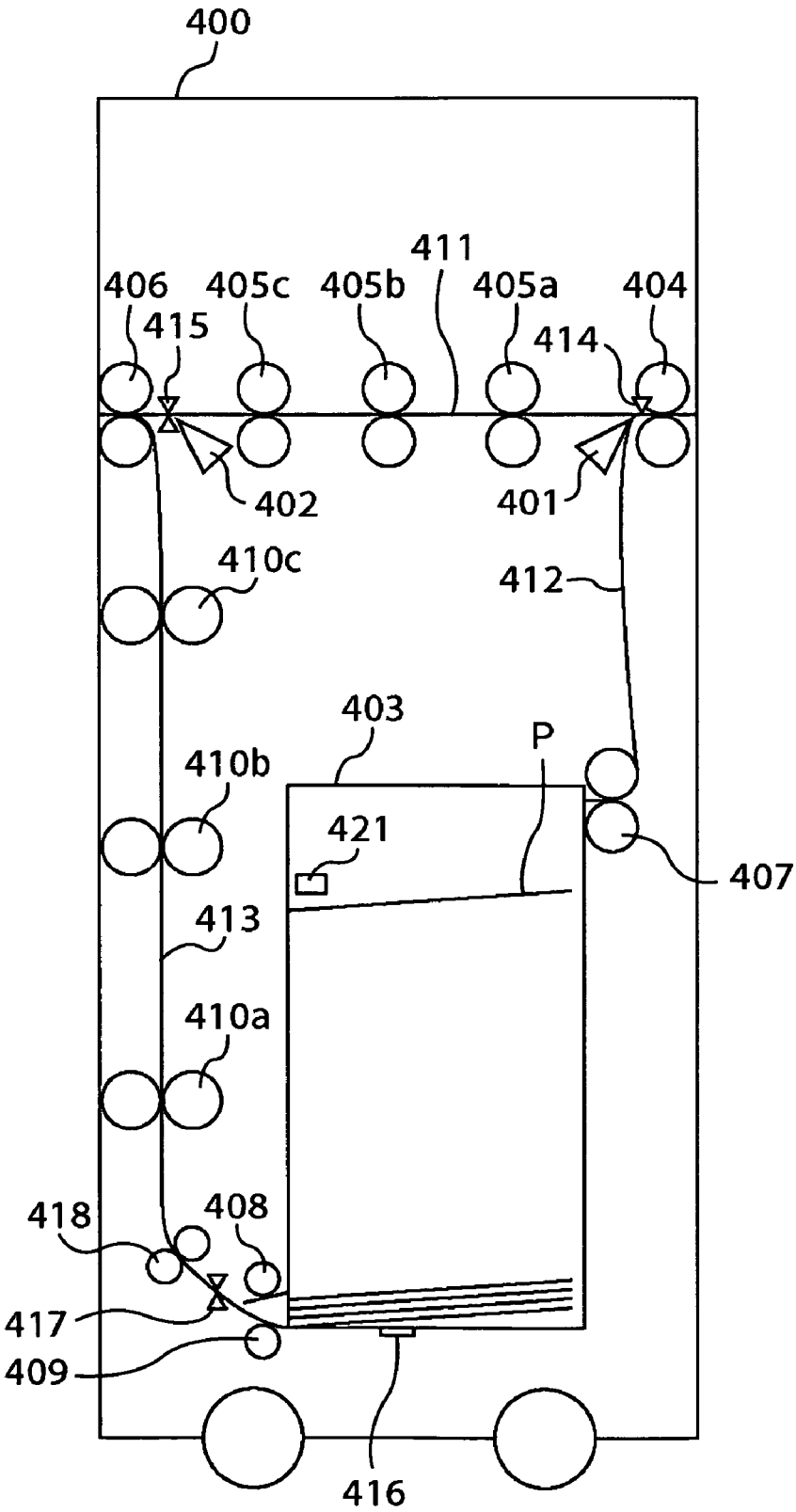
FIG. 2 illustrates the detailed inner structure of a buffer module.

FIG. 2 illustrates in detail the inner structure of the inside of the buffer module 400.

The buffer module 400, as illustrated in FIG. 2, includes a pair of inlet rollers 404 for guiding a sheet ejected from the printer 300 into the buffer module 400. The inlet switching flapper 401 is provided downstream of the pair of inlet rollers 404 for guiding the sheet to the through path 411 or the inlet path 412. Moreover, the outlet switching flapper 402 for ejecting sheets, which are sent from the through path 411 and an ejection path 413, outside of the buffer module 400, an inlet sensor 414, and an ejection sensor 415 for detecting sheets are provided.

The sheet guided to the through path 411 by switching the inlet switching flapper 401 is sent towards a pair of ejection rollers 406 through pairs of conveying rollers 405 (405*a*, 405*b*, and 405*c*). The sheet sent to the pair of ejection rollers 406 is ejected outside the buffer module 400 and sent to the folding apparatus 500.

The sheet guided to the inlet path 412 by switching the inlet switching flapper 401 is sent towards the buffer tray 403 through a conveying roller 407 and is loaded on the buffer tray 403.

A supplying unit for supplying the sheets loaded on the buffer tray 403 to the folding apparatus 500 is provided at the lower portion of the buffer tray 403. The supplying unit includes a crescent roller 409, a separation roller 408, a separation and conveying roller 418, a separation sensor 417, and a sheet-detection sensor 416 for detecting whether a sheet is present in the buffer tray 403.

The crescent roller 409 and the separation roller 408 are rotated by a separation motor (not shown in the drawing) so as to separate one sheet at a time from the bottom of the stack stored in the buffer tray 403. The separation sensor 417 detects whether a sheet has been separated from the buffer tray 403. A separated sheet is sent to pairs of conveying rollers 410 (410*a*, 410*b*, and 410*c*) through the separation and conveying roller 418, is passed through the ejection path 413, and is supplied to the folding apparatus 500 through the pair of ejection rollers 406.

A full-load detection sensor 421 is provided at the upper portion of the buffer tray 403. The full-load detection sensor 421 detects a sheet when the sheet on the top of the stack in the buffer tray 403 reaches a position P.

Figure 3:
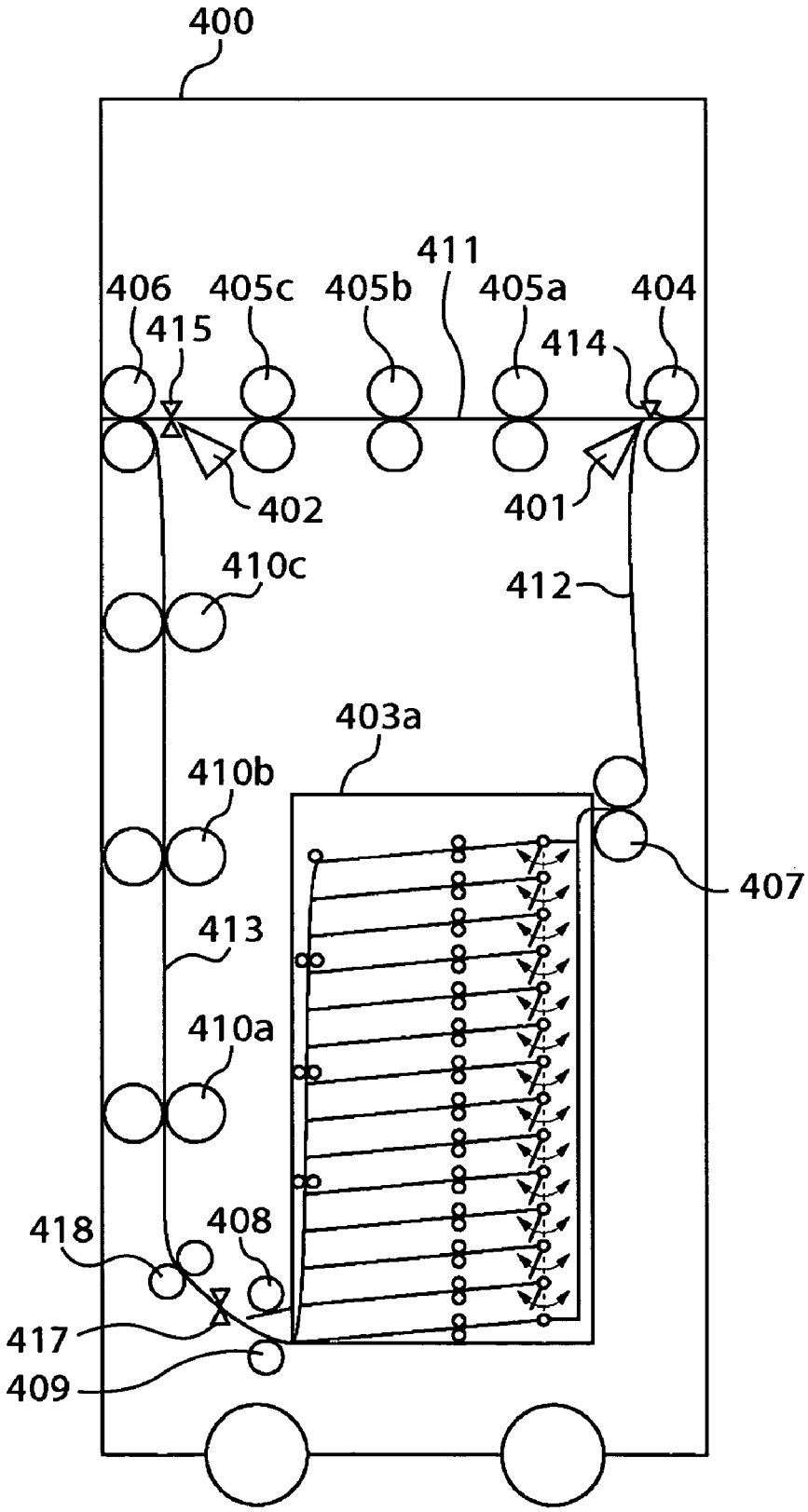
FIG. 3 illustrates another structure of a buffer module.

The buffer module 400 according to another embodiment, as illustrated in FIG. 3, may include buffer trays 403*a* having a plurality of trays used for different jobs provided by a user.

The buffer module 400 may be disposed after the folding apparatus 500 and the finisher main body 600 (which carries out only sorting, binding, and punching, and ejection is carried out by an ejection unit provided separately). By positioning the apparatuses in this way, documents that have been printed and post-processed can be temporarily stored in the buffer module 400 and can be output to the ejection tray when requested by the user.

A buffer tray having an authentication lock mechanism may be added to the buffer module 400 so that the buffer tray can be opened only by an administrator or the owner of the document.

Figure 4:
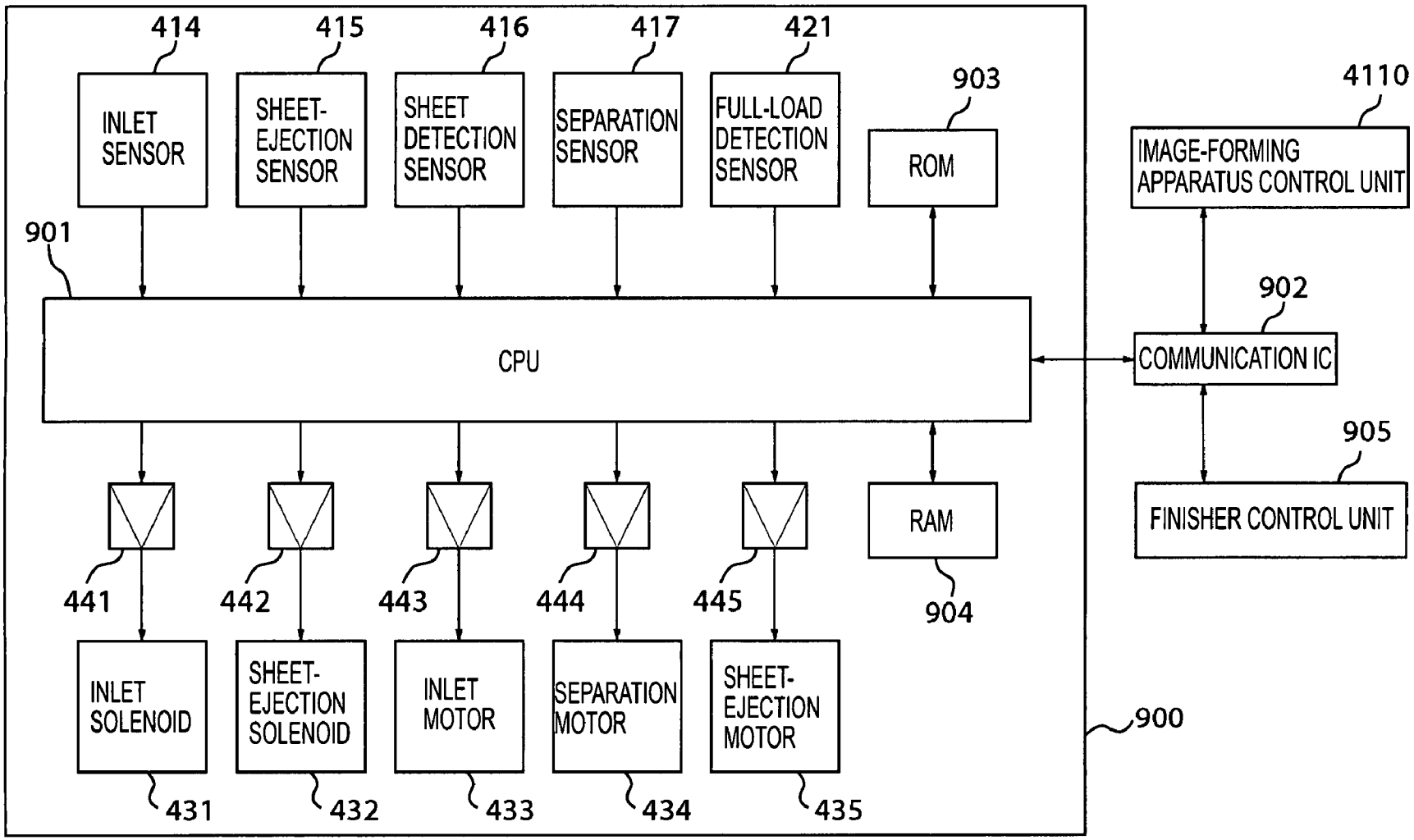
FIG. 4 is block diagram illustrating the structure of a control circuit controlling the operation of a buffer module.

FIG. 4 is a block diagram illustrating the structure of a control circuit 900 for controlling the operation of the buffer module 400.

The structure of the control circuit 900 is centered on a microprocessor 901 (hereinafter referred to as a "CPU 901"). Drive circuits having various loads and various sensors are connected to input-output ports of the CPU 901.

The control circuit 900 includes a random access memory (RAM) 904 that is used as a space for temporarily storing control data and a work space for carrying out computations required for control. The control circuit 900 also includes a read only memory (ROM) 903 where control sequence software is stored. The control circuit 900 is connected to an integrated circuit (IC) 902 for communication configured to control data communication with an image-forming apparatus control unit 4110 and a finisher control unit 905.

An inlet motor 433 is driven by a driver 443. An excitation signal and a motor current control signal are sent from the CPU 901 to the driver 443. Similarly, a separation motor 434 and an ejection motor 435 are driven by drivers 444 and 445 that receive input signals from the CPU 901. An inlet solenoid 431 and an ejection solenoid 432 are driven by drivers 441 and 442, respectively. The drivers 441 to 445 are connected to output ports of the CPU 901, and their operations are controlled by signals sent from the CPU 901.

The various sensors, such as the inlet sensor 414, the ejection sensor 415, the sheet-detection sensor 416, the separation sensor 417, and the full-load detection sensor 421, are connected to the input ports of the CPU 901. The detection signals from the sensors are used to control the sheet-conveying inside the buffer module 400 and to control the driving load.

Figure 5:
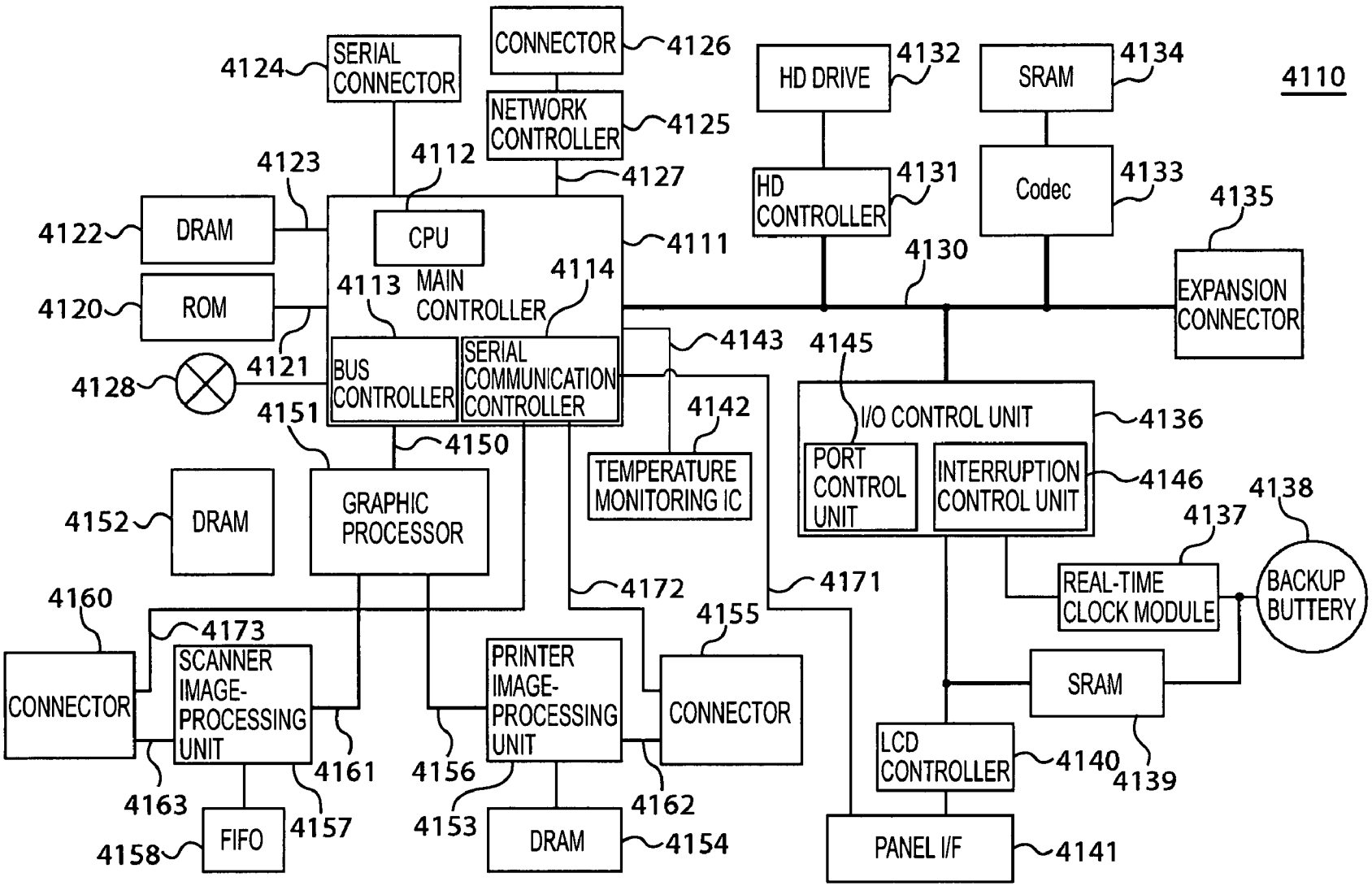
FIG. 5 is block diagram illustrating the inner structure of the image-forming apparatus control unit shown in FIG. 4.

FIG. 5 is a block diagram illustrating the inner structure of the image-forming apparatus control unit 4110 shown in FIG. 4.

As illustrated in FIG. 5, a main controller 4111 mainly includes a CPU 4112, a bus controller 4113, and a serial communication controller 4114.

The CPU 4112 and the bus controller 4113 control the operation of the entire image-forming apparatus control unit 4110. The CPU 4112 operates based on a program read out from a ROM 4120 via a ROM interface (I/F) 4121. The program includes instructions for a process of interpreting a page-description language (PDL) code data received from a host computer and expanding the PDL code data into raster image data. In this way, interpretation and expansion can be processed by software. The bus controller 4113 controls data transfer of data input and output from each I/F. Moreover, the bus controller 4113 resolves bus conflicts and controls direct memory access (DMA) data transfer.

A dynamic RAM (DRAM) 4122 is connected to the main controller 4111 via a DRAM I/F 4123. The DRAM 4122 is used as a work area for the operation of the CPU 4112 and a storage area for image data.

An asynchronous serial communication controller 4114 transmits and receives control commands between the image reader 200 and the printer 300 via serial buses 4172 and 4173. The asynchronous serial communication controller 4114 also carries out communication between a touch panel and a key input unit of an operation unit (not shown in the drawing).

A network controller 4125 is connected to the main controller 4111 via an I/F 4127 and is connected to an external network via a connector 4126. A typical network is an Ethernet™. The network controller 4125 of the image-forming apparatus control unit 4110 receives image data (graphic information) corresponding to a plurality of pages and an image-forming job including processing condition information of the image data at the image-forming apparatus 1000. The processing condition information, for example, includes information on whether double-sided printing or single-sided printing is carried out and information on which sheet-processing apparatus is used to carry out an image-forming job.

A graphic processor 4151 of the image-forming apparatus control unit 4110 receives image data (graphic information) from the image reader 200 via a connector 4160. Image data sent from the image reader 200 is input to the graphic processor 4151 as an image-forming job including processing condition information on how the image data is to be processed at the document-conveying apparatus 100.

A serial connector 4124 is connected to the main controller 4111 and carries out communication with external apparatuses. A typical serial bus is a universal serial bus (USB).

A fan 4128 is connected to the main controller 4111 and cools the image-forming apparatus control unit 4110.

A temperature-monitoring IC 4142 is connected to the main controller 4111 via a serial bus 4143. The temperature-monitoring IC 4142 is used for controlling the fan 4128 and for adjusting the temperature of a real-time clock module 4137.

A multi-purpose high-speed bus 4130 is connected to an expansion connector 4135 for connecting an expansion board, an input/output (I/O) control unit 4136, a hard drive (HD) controller 4131, and a Codec 4133. A typical multi-purpose high-speed bus is a protocol control information (PCI) bus.

The Codec 4133 compresses the raster image data stored in the DRAM 4122 in accordance with a standard such as MH/MR/MMR/JBIG/JPEG or expands compressed code data into raster image data. A static RAM (SRAM) 4134 is used as a temporary work area of the Codec 4133. Data transfer between the Codec 4133 and the DRAM 4122 is controlled by the bus controller 4113 and is DMA transferred.

The HD controller 4131 is used to connect an external storage apparatus. In this embodiment, a hard disk drive 4132 is connected via the HD controller 4131. The hard disk drive 4132 is used to store programs and image data.

The I/O control unit 4136 controls the multi-purpose high-speed bus 4130, a port control unit 4145, and an interruption control unit 4146.

A panel I/F 4141 is connected to a liquid crystal display (LCD) controller 4140 and includes an I/F for displaying images on a liquid crystal screen on an operation unit (not shown in the drawing) and a key input I/F for receiving input from hard keys or touch panel keys.

The operation unit includes a liquid crystal display unit, a touch panel input device attached to the liquid crystal display unit, and a plurality of hard keys. An input signal from the touch panel input device or the hard keys is transmitted to the CPU 4112 via the panel I/F 4141. The liquid crystal display unit is used for displaying image data sent from the panel I/F 4141. The liquid crystal display unit is capable of displaying the operational functions of the image-forming apparatus according to this embodiment and displaying image data.

The real-time clock module 4137 is used to update and store dates and time managed by the apparatuses and is backed up by a backup battery 4138.

An SRAM 4139 is backed up by the backup battery 4138 and stores user mode information, information on various settings, and file management information of the hard disk drive 4132.

A graphic processor 4151 carries out processes, such as image rotation, image magnification, color space transformation, digitization, scanner image input, and printer image output, on the image data stored in the DRAM 4122. A DRAM 4152 is used as a temporary work area of the graphic processor 4151. The graphic processor 4151 is connected to the main controller 4111 via a connector 4150. DMA data transfer between the graphic processor 4151 and the DRAM 4122 is controlled by the bus controller 4113.

The connector 4160 and a connector 4155 are connected to the image reader 200 and the printer 300, respectively. An asymmetrical serial I/F 4173 and a video I/F 4163 are connected to the connector 4160, and an asymmetrical serial I/F 4172 and a video I/F 4162 are connected to the connector 4155.

A scanner image-processing unit 4157 is connected to the image reader 200 via the connector 4160 and to the graphic processor 4151 via a scanner bus 4161. The scanner image-processing unit 4157 is capable of processing the image received from the image reader 200 in a predetermined manner and is capable of outputting a control signal generated based on a video control signal sent from the image reader 200 to the scanner bus 4161.

A First-in, First-out (FIFO) 4158 is connected to the scanner image-processing unit 4157 and is used to line-correct video signals sent from the image reader 200.

A printer image-processing unit 4153 is connected to the printer 300 via the connector 4155 and is connected to the graphic processor 4151 via a printer bus 4156. The printer image-processing unit 4153 is capable of processing image data output from the graphic processor 4151 in a predetermined manner and is capable of outputting the processed image data to the printer 300. The printer image-processing unit 4153 is also capable of outputting a control signal generated based on the video control signal sent from the printer 300 to the printer bus 4156.

A DRAM 4154 is connected to the printer image-processing unit 4153 and is used to delay the video signal for a predetermined amount of time.

The data transfer of the raster image data expanded in the DRAM 4122 to the printer 300 is controlled by the bus controller 4113. The raster image data is DMA transferred to the printer 300 via the graphic processor 4151, the printer image-processing unit 4153, and the connector 4155.

Figure 6:
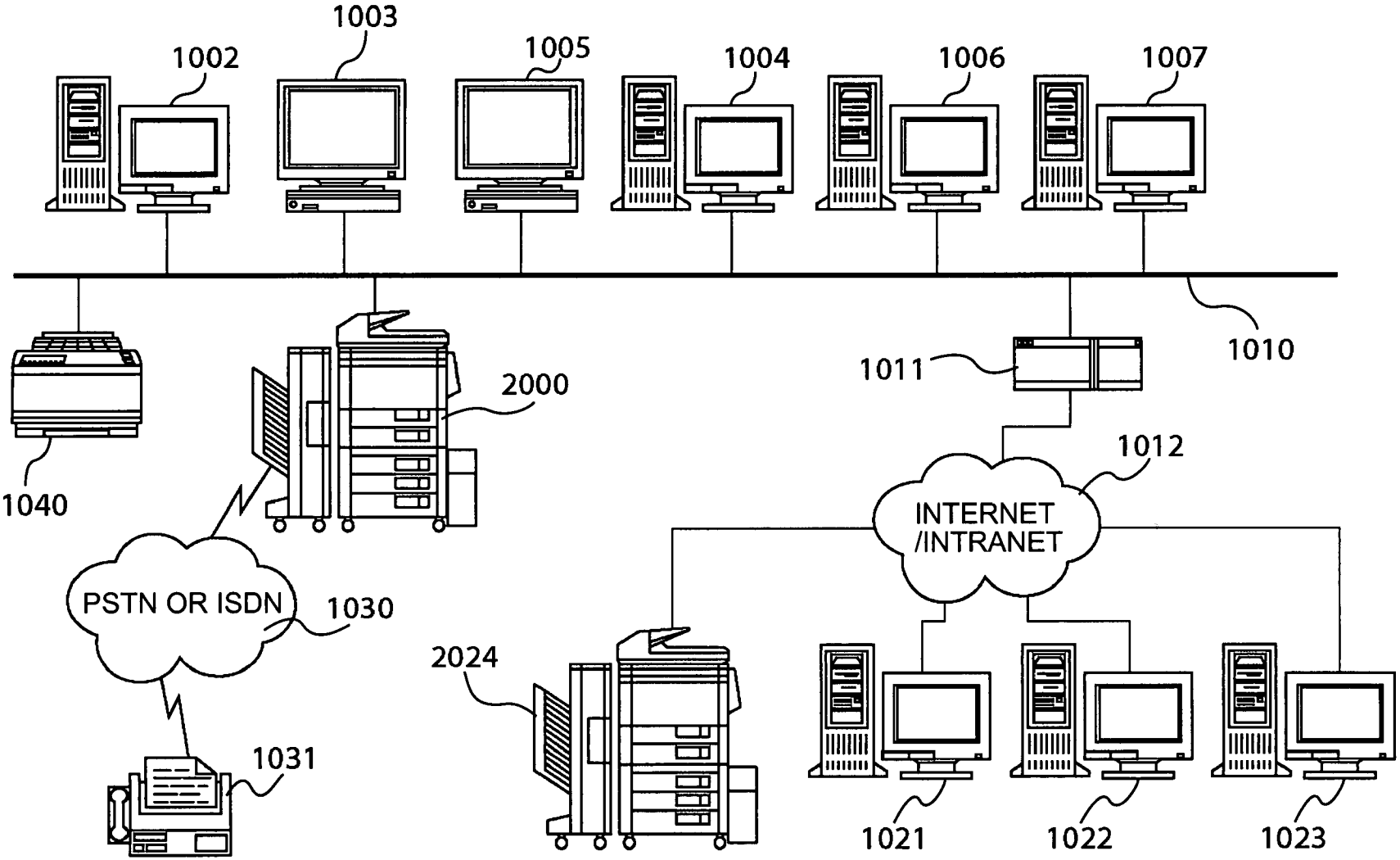
FIG. 6 illustrates the structure of the entire network system including the image-forming system shown in FIG. 1.

FIG. 6 illustrates the structure of the entire network system including the image-forming system shown in FIG. 1.

FIG. 6 illustrates an image-forming system 2000, which is the image-forming system illustrated in FIG. 1. The image-forming system 2000 sends an image read out from the image reader 200 to a local area network (LAN) 1010 and also sends an image received from the LAN 1010 to the printer 300 so as to print out the image. An image read out from the image reader 200 is sent to a public switched telephone network (PSTN) or to an integrated service digital network (ISDN) 1030 by a facsimile transmission unit (not shown in the drawing). Moreover, an image received from the PSTN or ISDN 1030 is sent to the printer 300 so as to print out the image.

A database server 1002 stores digital images and multi-valued images read by the image-forming system 2000 and controls the images in a database. A database client 1003 of the database server 1002 is a client terminal apparatus capable of viewing and retrieving image data stored in the database server 1002. An electronic mail server 1004 is capable of receiving an image read by the image-forming system 2000 as an attachment of an electronic mail (E-mail) message. An electronic mail client 1005 is a client terminal apparatus capable of receiving and viewing electronic mail received by the electronic mail server 1004 and capable of sending E-mail. A World Wide Web (WWW) server 1006 provides a hyper text markup language (HTML) document to the LAN 1010. The HTML document provided by the WWW server 1006 can be printed out from the image-forming system 2000. A domain name system (DNS) server 1007 is capable of relating an Internet protocol (IP) address to an alphabetical character string. A router 1011 links the LAN 1010 to the Internet/intranet 1012.

The Internet/intranet 1012 is linked to a database server 1021, a WWW server 1022, an electronic mail server 1023, and an image-forming system 2024, which are similar apparatuses as the above-described database server 1002, WWW server 1006, electronic mail server 1004, and image-forming system 2000, respectively.

The image-forming system 2000 is connected to a facsimile apparatus 1031 via a PSTN or ISDN 1030 and is capable of receiving and transmitting facsimile signals. A printer 1040 corresponding to a network is connected to the LAN 1010, enabling images read by the image-forming system 2000 to be printed out from the printer 1040.

Printer drivers are installed in the database client 1003 and the electronic mail client 1005. The electronic mail client 1005 converts document data into print data via the printer driver and sends the print data to the image-forming system 2000, the image-forming system 2024, or the printer 1040. The image-forming system 2000, the image-forming system 2024, or the printer 1040 enables a network printing operation by printing out an image based on the received print data.

Next, a method for controlling electrical power in the image-forming system shown in FIG. 1 will be described.

Figure 7:
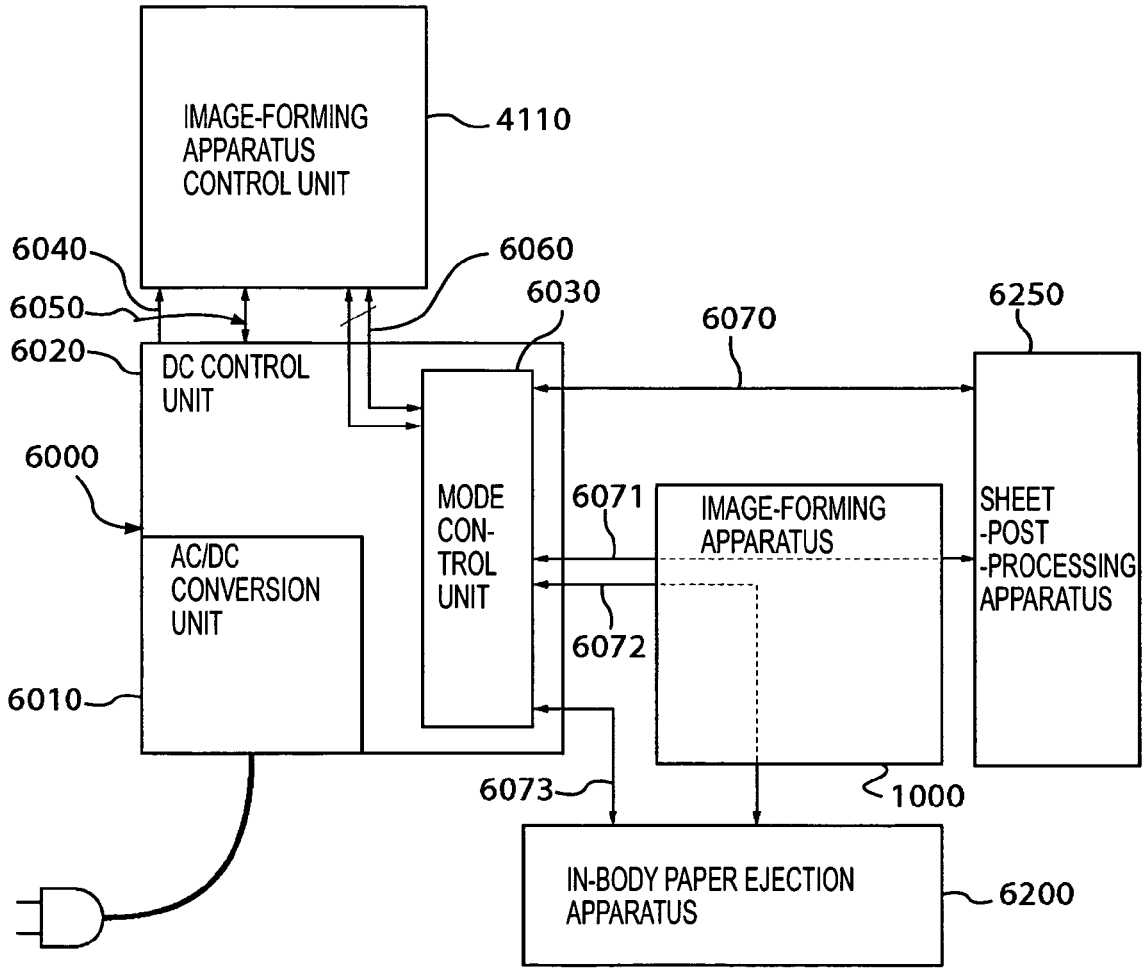
FIG. 7 is a block diagram illustrating the structure of an electrical power control unit of the image-forming system shown in FIG. 1.

FIG. 7 is a block diagram illustrating the structure of an electrical power control unit in the image-forming system shown in FIG. 1.

An electrical power control unit 6000 controls the electrical power supply to the image-forming apparatus control unit 4110, the image-forming apparatus 1000, an in-body paper ejection apparatus 6200, and an sheet post-processing apparatus 6250. The in-body paper ejection apparatus 6200 carries out an ejection process of a sheet and, for example, is an apparatus equivalent to the buffer module 400. The sheet post-processing apparatus 6250 carries out predetermined post-processing (for example, stapling and punching) on a sheet and, for example, is equivalent to the finisher main body 600. FIG. 7 illustrates a sheet-ejection apparatus and a sheet post-processing apparatus that are sheet-processing apparatuses configured to process sheets. However, the control by the electrical power control unit 6000 may also be applied to a sheet-conveying process for conveying a sheet or a sheet-feeding process for feeding a sheet to the image-forming apparatus 1000.

The electrical power control unit 6000 mainly includes an alternating current/direct current (AC/DC) converting unit 6010 configured to convert an alternating current power source into a direct current power source, a DC control unit 6020 configured to carry out DC/DC voltage conversion and DC voltage control, and an electrical power mode control unit 6030 configured to control an electrical mode. The electrical power mode control unit 6030 is capable of controlling the electrical power supply to the sheet post-processing apparatus 6250, the in-body paper ejection apparatus 6200, and an image-forming apparatus 1000.

A power supply constantly turned on is connected to a predetermined region of the image-forming apparatus control unit 4110 from the DC control unit 6020 via a line 6040. Thus, the image-forming apparatus control unit 4110 is capable of receiving jobs from the network while it is set to a power-saving mode (sleep mode) in which the maximum amount of power is saved. An electrical power control signal for controllers is sent from the constantly-turned-on predetermined region of the image-forming apparatus control unit 4110 via a line 6050. In accordance with this signal, the electrical power control unit 6000 shuts off the power supply to the regions of the image-forming apparatus control unit 4110 that do not have to be operated (i.e., the regions other than the above-mentioned predetermined region) during sleep mode and stand-by mode.

An electrical power control signal for printers is sent from the predetermined region of the image-forming apparatus control unit 4110 to the electrical power mode control unit 6030 of the electrical power control unit 6000. The electrical power mode control unit 6030 controls the electrical power supply to the image-forming apparatus 1000, the in-body paper ejection apparatus 6200, and the sheet post-processing apparatus 6250 via lines 6070 to 6073 in accordance with the electrical power control signal. Although details will be described with reference to FIGS. 8 and 9, the electrical power control signal for printers output from the image-forming apparatus control unit 4110 stops the electrical power supply to the in-body paper ejection apparatus 6200 or the sheet post-processing apparatus 6250. The electrical power supply to each of the image-forming apparatus 1000, the in-body paper ejection apparatus 6200, and the sheet post-processing apparatus 6250 can also be stopped. The electrical power supply to the image-forming apparatus 1000 can be stopped independently but since this process is not practical in this embodiment, descriptions are omitted.

The process of changing the image-forming apparatus control unit 4110, the image-forming apparatus 1000, the in-body paper ejection apparatus 6200, and the sheet post-processing apparatus 6250 from a power-on state to a power-off state in which the electrical power supply to predetermined apparatuses are shut off is described with reference to FIG. 8.

Figure 8:
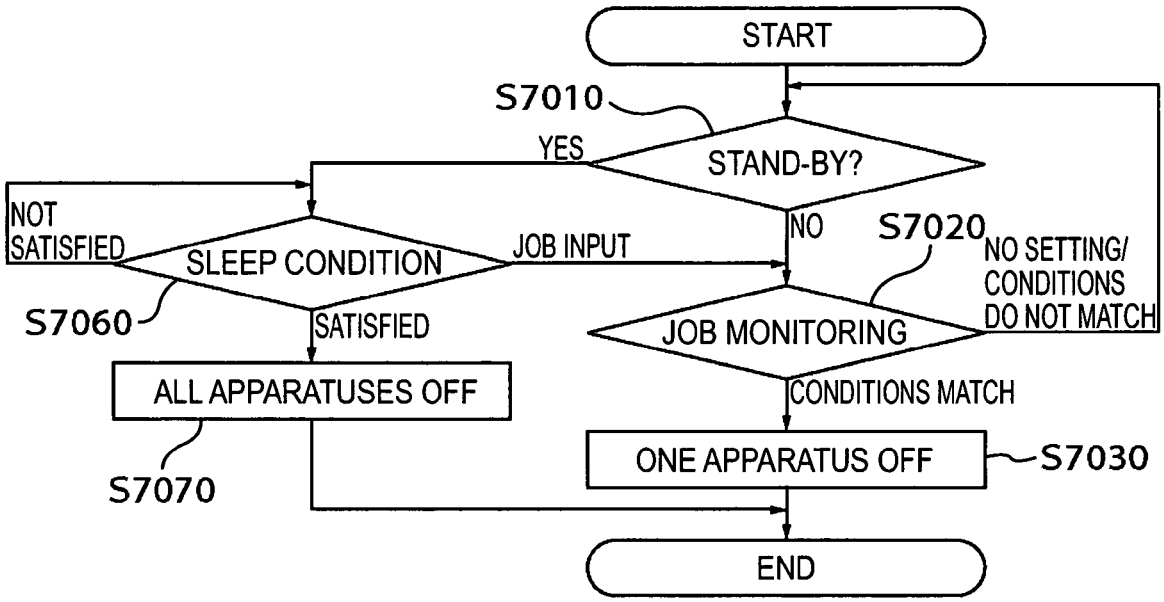
FIG. 8 is a flow chart illustrating the process for changing an image-forming apparatus control unit, an image-forming apparatus, an in-body paper ejection apparatus, and a sheet post-processing apparatus from a power-on state to a power-off state.

FIG. 8 is a flow chart illustrating the process of changing the image-forming apparatus control unit 4110, the image-forming apparatus 1000, the in-body paper ejection apparatus 6200, and the sheet post-processing apparatus 6250 from a power-on state to a power-off state. This process is carried out at a predetermined region of the image-forming apparatus control unit 4110 that is constantly turned on.

First, the image-forming apparatus control unit 4110 determines whether the image-forming apparatus 1000 is in a print waiting state (stand-by) in which the image-forming apparatus control unit 4110 waits for a print job to be input (S7010). The process proceeds to Step S7060 if a print job is not received (i.e., if the stand-by state continues), and the process proceeds to Step S7020 if a print job is received.

In Step S7060, the image-forming apparatus control unit 4110 determines whether a predetermined sleep condition (a condition in which the image-forming apparatus 1000 enters a power-saving state (for example, an electrical power shut-off state)) is satisfied. The sleep condition, for example, is a condition in which the image-forming apparatus 1000 continues to be in stand-by mode so that images are not formed on a sheet for a predetermined amount of time (for example, sixty minutes) or in which a user sets a sleep mode by manually pressing a power-saving key (not shown in the drawings) provided on the panel I/F 4141. The process proceeds to Step S7070 if the sleep condition is satisfied. If the sleep condition is not satisfied, the process repeats Step S7060 (follows the "not satisfied" arrow of Step S7060 in FIG. 8) until the condition is satisfied. If a print job is input while the image-forming apparatus control unit 4110 is waiting for a sleep condition to be satisfied, the process proceeds to Step S7020.

In Step S7070, the power supply to the other regions of the image-forming apparatus control unit 4110, the image-forming apparatus 1000, the in-body paper ejection apparatus 6200, and the sheet post-processing apparatus 6250 is shut off so as to change the mode of the image-forming apparatus 1000 to sleep mode when the sleep condition is satisfied.

In Step S7020, when a new print job (image-forming job) satisfying a sleep condition is input, the image-forming apparatus control unit 4110 monitors the execution of the print job and determines whether the execution of the print job conforms to a predetermined condition. The predetermined condition is set in advance, and the condition is, for example, one of the in-body paper ejection apparatus 6200 and the sheet post-processing apparatus 6250 not being used for a predetermined amount of time. When the predetermined condition is satisfied, the process proceeds to Step S7030. When the predetermined condition is not satisfied or when a predetermined condition is not set, the process proceeds to Step S7010. The predetermined condition can be set for each of the in-body paper ejection apparatus 6200 and the sheet post-processing apparatus 6250. For example, in some cases, the processing condition information of the print job may not include information indicating that the in-body paper ejection apparatus 6200 is to be used. In such a case, the in-body paper ejection apparatus 6200 can be set so that, if the in-body paper ejection apparatus 6200 is not used for a print job for a first amount of time (for example, 30 minutes), the process proceeds to Step S7030. In another case, the processing condition information of the print job may not include information indicating that the sheet post-processing apparatus 6250 is to be used. In such a case, the sheet post-processing apparatus 6250 can be set so that, if the sheet post-processing apparatus 6250 is not used for a second amount of time (for example, 45 minutes), the process proceeds to Step 7030.

In Step S7030, the image-forming apparatus control unit 4110 sends a signal to the electrical power mode control unit 6030 so as to shut off electrical supply to one of the in-body paper ejection apparatus 6200 and the sheet post-processing apparatus 6250, whichever apparatus that has not been used for a predetermined amount of time. The predetermined amount of time is set individually for the in-body paper ejection apparatus 6200 and the sheet post-processing apparatus 6250 wherein the predetermined amount of time for the in-body paper ejection apparatus 6200 is defined as a first amount of time and the predetermined amount of time for the sheet post-processing apparatus 6250 is defined as a second amount of time. If the electrical power mode control unit 6030 receives a signal instructing the power to the in-body paper ejection apparatus 6200 to be shut off from the image-forming apparatus control unit 4110, the electrical power mode control unit 6030 shuts off the electrical power supply to the in-body paper ejection apparatus 6200. If the electrical power mode control unit 6030 receives a signal instructing the power to the sheet post-processing apparatus 6250 to be shut off from the image-forming apparatus control unit 4110, the electrical power mode control unit 6030 shuts off the electrical power supply to the sheet post-processing apparatus 6250.

Among the in-body paper ejection apparatus 6200 and the sheet post-processing apparatus 6250, the apparatus to be used preferentially may be set in advance according to the above-described predetermined condition. For example, if the in-body paper ejection apparatus 6200 is set as the apparatus to be used preferentially, the electrical power mode control unit 6030 shuts off the electrical power supply to the in-body paper ejection apparatus 6200 when the first amount of time (for example, 30 minutes) elapses without the in-body paper ejection apparatus 6200 being used. Furthermore, the electrical power supply to the sheet post-processing apparatus 6250 can be shut off at the same time as the in-body paper ejection apparatus 6200 even if the predetermined amount of time (second amount of time) for the sheet post-processing apparatus 6250 is set longer (for example, set at 45 minutes) than the first amount of time for the in-body paper ejection apparatus 6200.

As described above, the first amount of time and the second amount of time are set as different amounts of time (i.e., 30 minutes and 45 minutes). However, the first and second amounts of time may be set as the same amounts of time (for example, 30 minutes).

Figure 9:
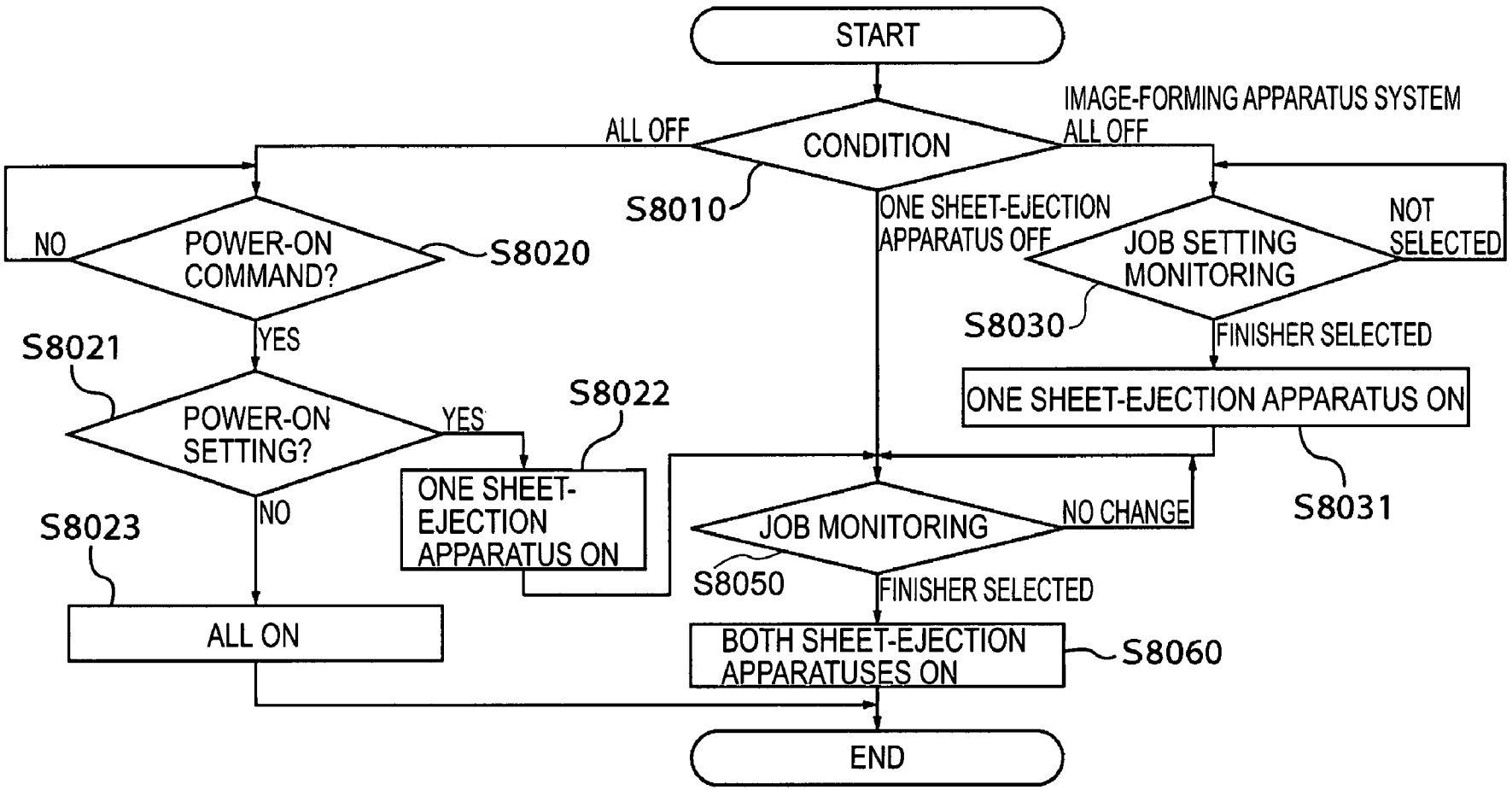
FIG. 9 is a flow chart illustrating the process for changing the remaining regions of the image-forming apparatus control unit, the image-forming apparatus, the in-body paper ejection apparatus, and the sheet post-processing apparatus from a power-off state to a power-on state.

FIG. 9 illustrates the process of turning on the electrical power supply to one of the other regions of the image-forming apparatus control unit 4110, the image-forming apparatus 1000, the in-body paper ejection apparatus 6200, and the sheet post-processing apparatus 6250 when the electrical power supply to one of the above apparatuses is shut off.

FIG. 9 is a flow chart illustrating the process of turning on the electrical power supply of one of the remaining regions of the image-forming apparatus control unit 4110, the image-forming apparatus 1000, the in-body paper ejection apparatus 6200, and the sheet post-processing apparatus 6250. This process is carried out in a region of the image-forming apparatus control unit 4110 that is constantly turned on.

First, it is determined whether or not electrical power supply is shut off (S8010). When the electrical power supply to all four apparatuses, i.e., the other regions of the image-forming apparatus control unit 4110, the image-forming apparatus 1000, the in-body paper ejection apparatus 6200, and the sheet post-processing apparatus 6250, is shut off and the apparatuses are in a complete sleep mode, the process proceeds to Step S8020. If the electrical power supply to all regions of the image-forming apparatus control unit 4110 is turned on and the electrical power supply to the other three apparatus, i.e., the image-forming apparatus 1000, the in-body paper ejection apparatus 6200, and the sheet post-processing apparatus 6250, is shut off, the process proceeds to Step S8030. If the electrical power supply to the image-forming apparatus control unit 4110, the image-forming apparatus 1000, and one of the in-body paper ejection apparatus 6200 and the sheet post-processing apparatus 6250 is turned on and the electrical power supply to one of the in-body paper ejection apparatus 6200 and the sheet post-processing apparatus 6250 is shut off, the process proceeds to Step S8050.

In Step S8020, it is determined whether a power-on command has been input by a user or a print job including a power-on command has been input. If a power-on command is detected, the process proceeds to Step S8021, and if a power-on command is not detected, the process is returned to Step S8020 to wait for a power-on command to be input.

In Step S8021, it is determined whether the power-on command is for only one of the in-body paper ejection apparatus 6200 and the sheet post-processing apparatus 6250. If the power-on command is for only one of the in-body paper ejection apparatus 6200 and the sheet post-processing apparatus 6250, the process proceeds to Step S8022, and if not, the process proceeds to Step S8023.

In Step S8022, the electrical power supply to the other regions of the image-forming apparatus control unit 4110 and the image-forming apparatus 1000 is turned on and the electrical power supply to the in-body paper ejection apparatus 6200 or the sheet post-processing apparatus 6250, whichever is set to be turned by the power-on command, is turned on. Then, the process proceeds to Step S8050.

In Step S8023, the electrical power supply to all four apparatuses, i.e., the other regions of the image-forming apparatus control unit 4110, the image-forming apparatus 1000, the in-body paper ejection apparatus 6200, and the sheet post-processing apparatus 6250, is turned on, and the process is completed.

In cases, such as making a copy or a print out and sending a facsimile message, in which the type of the default finisher for output can be assigned, the electrical power supply can be controlled so that power to the finishers is turned on and power to other finishers is shut off (S8022). If there are no predetermined settings when the power-on command is received, electrical power is supplied to all four apparatuses, i.e., the other regions of the image-forming apparatus control unit 4110, the image-forming apparatus 1000, the in-body paper ejection apparatus 6200, and the sheet post-processing apparatus 6250 (S8023).

To shut off the electrical power supply to the image-forming apparatus 1000, the in-body paper ejection apparatus 6200, and the sheet post-processing apparatus 6250, the lines 6070 and 6072, as illustrated in FIG. 7, can be activated so as to transmit the electrical power control selection signal or the lines 6071 and 6073 can be activated so as to transmit the electrical power control selection signal. Which pair of lines to be activated depends on the settings set by the user.

In Step S8030, as illustrated in FIG. 9, the job setting is monitored since electrical power is supplied to the image-forming apparatus control unit 4110 and electrical power is not supplied to the other three apparatuses, i.e., the image-forming apparatus 1000, the in-body paper ejection apparatus 6200, and the sheet post-processing apparatus 6250. If one of the in-body paper ejection apparatus 6200 and the sheet post-processing apparatus 6250 is selected on the basis of the job setting, the process proceeds to Step S8031, and if neither is selected, the process returns to Step S8030 to wait for one of the apparatuses to be selected.

In Step S8031, electrical power is supplied to one of the in-body paper ejection apparatus 6200 and the sheet post-processing apparatus 6250, whichever is selected, and the image-forming apparatus 1000. Then, the process proceeds to Step S8050.

In Step S8050, the job is monitored since electrical power is supplied to the image-forming apparatus control unit 4110, the image-forming apparatus 1000, and one of the in-body paper ejection apparatus 6200 and the sheet post-processing apparatus 6250 and electrical power is not supplied to the other one of the in-body paper ejection apparatus 6200 and the sheet post-processing apparatus 6250. If, as a result of monitoring the job, a finisher with the electrical power supply shut off is selected, the process proceeds to Step S8060, and if a finisher with the electrical power supply shut off is not selected, the process proceeds to Step S8050 to wait for a finisher with the electrical power supply turned off to be selected.

In Step S8060, electrical power is supplied to the selected finisher and to all four apparatuses, i.e., the image-forming apparatus control unit 4110, the image-forming apparatus 1000, the in-body paper ejection apparatus 6200, and the sheet post-processing apparatus 6250.

In Step S8050, if a finisher with its electrical power supply shut off is not selected, the step is repeated until a finisher with its electrical power supply shut off is selected. However, the process may proceed to Step S7060, as illustrated in FIG. 8, after such a waiting state continues for a predetermined amount of time.

As described above, among the plurality of finishers (the in-body paper ejection apparatus 6200 and the sheet post-processing apparatus 6250) connected to a multi-function apparatus (the image-forming system), the electrical power supply to finishers not operating can be shut off, and, thus, unnecessary electrical power consumption can be prevented.

Other Embodiments

An embodiment of the present invention can also be realized by supplying a storage medium storing a software program code for realizing the functions of the above-described embodiment to a system or an apparatus and by reading out and executing the program code stored on the storage medium by a computer (CPU or micro-processing unit (MPU)) of the system or apparatus.

In such a case, the program code read out from the storage medium realizes a novel function according to an embodiment of the present invention and the storage medium storing the program code and the program code itself constitutes an embodiment of the present invention.

The storage medium for supplying the program code may be a flexible disk, a hard disk, an optical disk, a magnetic optical disk, a compact disk read only memory (CD-ROM), a compact disk readable (CD-R), a compact disk rewritable (CD-RW), a digital versatile disk read only memory (DVD-ROM), a DVD random access memory (DVD-RAM), a DVD-RW, a DVD+RW, a magnetic tape, a non-volatile memory car, or a ROM. The above-described program may be supplied by downloading the program from the Internet, a commercial network, or another computer or database connected to a local area network.

The functions according to an embodiment of the present invention are not only realized by executing the program code read out by the computer but also realized by an operating system (OS) operating on a computer carrying out part or all of the actual process according to the program code.

The functions according to an embodiment of the prqesent invention may be realized by a CPU included in a function expansion board or a function expansion unit carrying out part or all of the actual process according to the program code read out from the storage medium.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-304519 filed Oct. 19, 2004, which is hereby incorporated by reference herein in its entirety.

What is claimed is:

1. An image-forming apparatus comprising:

an input unit configured to input an image-forming job including image information corresponding to a plurality of pages and predetermined processing condition information;

an image-forming unit configured to form an image on a sheet on the basis of the image information of the image-forming job;

a first sheet-processing unit configured to process a sheet on which an image is formed by the image-forming unit;

a second sheet-processing unit configured to process a sheet on which an image is formed by the image-forming unit;

an electrical power control unit configured to control electrical power supply to the first sheet-processing unit and the second sheet-processing unit; and a determining unit configured to determine whether or not sheet processing for the image-forming job is to be carried out by one of the first sheet-processing unit and the second sheet-processing unit on the basis of the processing condition information included in the image-forming job input by the input unit, wherein the electrical power control unit shuts off electrical power supply to the first sheet-processing unit responsive to the determining unit determining that sheet processing by the first sheet-processing unit is not carried out for a first amount of time, and wherein the electrical power control unit shuts off electrical power supply to the second sheet-processing unit responsive to the determining unit determining that sheet processing by the second sheet-processing unit is not carried out for a second amount of time.

2. The image-forming apparatus according to claim 1, wherein the sheet processing includes at least one of a sheet conveying process for conveying the sheet, a sheet ejection process for ejecting the sheet, and a feeding process for feeding the sheet to the image-forming unit.

3. The image-forming apparatus according to claim 1, wherein the input unit inputs the image-forming job transmitted from an external apparatus.

4. The image-forming apparatus according to claim 1, further comprising:

an image-reading unit configured to read a document and to obtain image information; and a setting unit configured to set a processing condition for reading image information by the image-reading unit, wherein the input unit inputs an image-forming job on the basis of the image information read by the image-reading unit and the processing condition information set by the setting unit.

5. The image-forming apparatus according to claim 1, wherein the determining unit determines whether or not to carry out the image-forming job by the image-forming unit, and wherein the electrical power control unit controls the electrical power supply to the image-forming unit and shuts off electrical power supply to the image-forming unit responsive to the determining unit determining that an image-forming process by the image-forming unit is not carried out for a third amount of time.

6. The image-forming apparatus according to claim 5, wherein the electrical power control unit controls the electrical power supply to the image-forming unit and shuts off electrical power supply to the first sheet-processing unit and the second sheet-processing unit responsive to the determining unit determining that an image-forming process by the image-forming unit is not carried out for a third amount of time.

7. The image-forming apparatus according to claim 1, wherein the first amount of time is shorter than the second amount of time.

8. The image-forming apparatus according to claim 1, wherein the first amount of time is the same as the second amount of time.

9. A method for controlling an image-forming apparatus, comprising the steps of:

an inputting step of inputting an image-forming job including image information corresponding to a plurality of pages and predetermined processing condition information;

an image forming step of forming an image on a sheet on the basis of the image information of the image-forming job;

a controlling step of controlling an electrical supply to a first sheet-processing unit and a second sheet-processing unit, the first and second sheet-processing units; and a determining step of determining whether or not sheet processing for the image-forming job is to be carried out by the first sheet-processing unit or the second sheet-processing unit on the basis of the processing condition information included in the image-forming job input in the inputting step, wherein the electrical power supply to the first sheet-processing unit is shut off in the controlling step when it is determined in the determining step that sheet processing by the first sheet-processing unit is not carried out for a first amount of time, and wherein the electrical power supply to the second sheet-processing unit is shut off in the controlling step when it is determined in the determining step that sheet processing by the second sheet-processing unit is not carried out for a second amount of time.

10. The method for controlling an image-forming apparatus according to claim 9, wherein the sheet processing is at least one of a sheet conveying process for conveying the sheet, a sheet ejection process for ejecting the sheet, and a feeding process for feeding the sheet.

11. The method for controlling an image-forming apparatus according to claim 9, wherein the image-forming job transmitted from an external apparatus is input in the inputting step.

12. The method for controlling an image-forming apparatus according to claim 9, further comprising:

a reading step of reading a document and obtaining image information; and a setting step of setting a processing condition for reading image information in the reading step, wherein an image-forming job based on the image information read in the reading step and the processing condition information set in the setting step are input in the inputting step.

13. The method for controlling an image-forming apparatus according to claim 9, wherein the determining step includes determining whether or not to carry out the image-forming job, and wherein an electrical power supply to an image-forming unit configured to carry out the image-forming job is shut off in the controlling step when it is determined that the image-forming job is not carried out for a third amount of time in the determining step.

14. The method for controlling an image-forming apparatus according to claim 13, wherein the electrical power supply to the image-forming unit is controlled in the controlling step and electrical power supply to the first sheet-processing unit and the second sheet-processing unit is shut off in the controlling step when it is determined in the determining step that the image-forming job is not carried out for the third amount of time.

15. The method for controlling an image-forming apparatus according to claim 9, wherein the first amount of time is shorter than the second amount of time.

16. The image-forming apparatus according to claim 9, wherein the first amount of time is the same as the second amount of time.

17. An image-forming apparatus comprising:

an input unit configured to input an image-forming job including image information corresponding to a plurality of pages and predetermined processing condition information;

an image-forming unit configured to form an image on a sheet on the basis of the image information of the image-forming job;

a plurality of sheet-processing units configured to process a sheet on which an image is formed by the image-forming unit; and an electrical power control unit configured to control electrical power supply to the plurality of sheet-processing units based on an information, that shows at least one sheet-processing unit used by the image-forming job, included in the predetermined processing condition information.

* * * * *